US007845341B2

(12) United States Patent
Lewis et al.

(10) Patent No.: US 7,845,341 B2
(45) Date of Patent: Dec. 7, 2010

(54) FLUID BLOCKER FOR AN INTAKE MANIFOLD

(75) Inventors: Joel K. Lewis, Bellefontaine, OH (US); Marcos J. DeLeon, Dublin, OH (US); Jared S. Shattuck, Powell, OH (US); Tanabe Yuichiro, Dublin, OH (US); Takeshi Aoki, Raymond, OH (US)

(73) Assignee: Honda Motor Co., Ltd., Tokyo (JP)

( * ) Notice: Subject to any disclaimer, the term of this patent is extended or adjusted under 35 U.S.C. 154(b) by 54 days.

(21) Appl. No.: 12/197,828

(22) Filed: Aug. 25, 2008

(65) Prior Publication Data

US 2008/0308058 A1 Dec. 18, 2008

Related U.S. Application Data

(62) Division of application No. 11/209,092, filed on Aug. 22, 2005, now Pat. No. 7,441,551.

(51) Int. Cl.
*F02B 25/06* (2006.01)

(52) U.S. Cl. ..... 123/572

(58) Field of Classification Search ..... 123/572–574, 123/41.86

See application file for complete search history.

(56) References Cited

U.S. PATENT DOCUMENTS 4,453,525 A 6/1984 DeBruler
4,823,759 A 4/1989 Mitami
4,958,613 A 9/1990 Hiraoka et al.
4,969,422 A * 11/1990 Ishikawa et al. ..... 123/41.86
5,277,154 A 1/1994 McDowell
5,450,835 A * 9/1995 Wagner ..... 123/573
5,884,612 A 3/1999 Takeyama et al.
6,192,848 B1 2/2001 Hada et al.
6,234,154 B1 5/2001 Spix
6,286,471 B1 9/2001 Powell
6,390,080 B1 5/2002 Dowding et al.
6,425,451 B2 * 7/2002 Yoshida et al. ..... 180/219
6,443,136 B1 * 9/2002 Suganami et al. ..... 123/572

(Continued)

FOREIGN PATENT DOCUMENTS

JP 03-033417 2/1991

(Continued)

OTHER PUBLICATIONS

Information Disclosure Statement filed Jun. 14, 2007 in U.S. Appl. No. 11/209,092.

(Continued)

*Primary Examiner*—M. McMahon
(74) *Attorney, Agent, or Firm*—Plumsea Law Group, LLC

(57) ABSTRACT

An intake manifold is disclosed. The intake manifold includes a first chamber in fluid communication with a PCV line and disposed generally upstream of a second chamber. The chambers are designed to provide a long flow path for the moisture laden PCV gas and to help reduce the introduction of moisture or fluids into the second chamber. This helps to prevent the ingestion of moisture or fluids by the combustion chambers of engine. An optional fluid blocker can also be used to trap fluids and help prevent those fluids from entering a cylinder port.

20 Claims, 9 Drawing Sheets

U.S. PATENT DOCUMENTS

| | | | | |
|---|---|---|---|---|
| 6,591,796 | B1 | 7/2003 | Scott | |
| 6,601,572 | B2 | 8/2003 | Okamoto | |
| 6,619,276 | B1 | 9/2003 | Miller et al. | |
| 6,782,878 | B2 | 8/2004 | Spix | |
| 6,802,292 | B2 | 10/2004 | Nelson et al. | |
| 6,817,325 | B2 | 11/2004 | Dinkel et al. | |
| 6,837,914 | B2 | 1/2005 | Baek | |
| 6,858,051 | B2 | 2/2005 | Uhlenbrock | |
| 7,007,682 | B2 | 3/2006 | Takahashi et al. | |
| 7,055,509 | B2 * | 6/2006 | Hara | 123/572 |
| 7,165,541 | B2 | 1/2007 | Hommes | |
| 7,441,551 | B2 * | 10/2008 | Lewis et al. | 123/572 |
| 2001/0032635 | A1 | 10/2001 | Kimura | |
| 2001/0052342 | A1 * | 12/2001 | Mammarella | 123/574 |
| 2002/0134361 | A1 | 9/2002 | Okamoto | |
| 2003/0070661 | A1 * | 4/2003 | Yasui | 123/572 |
| 2003/0230291 | A1 | 12/2003 | Ko | |
| 2004/0159314 | A1 | 8/2004 | Ishizuka et al. | |
| 2004/0211400 | A1 | 10/2004 | Basset | |
| 2004/0261776 | A1 * | 12/2004 | Knaus et al. | 123/572 |
| 2005/0005890 | A1 | 1/2005 | Asfaw et al. | |
| 2005/0092267 | A1 | 5/2005 | Nonaka et al. | |

FOREIGN PATENT DOCUMENTS

| | | |
|---|---|---|
| JP | 2003-254178 | 9/2003 |

OTHER PUBLICATIONS

Office Action mailed Jun. 1, 2007 in U.S. Appl. No. 11/209,092.
Response/Election filed Jul. 31, 2007 in U.S. Appl. No. 11/209,092.
Office Action mailed Sep. 18, 2007 in U.S. Appl. No. 11/209,092.
Amendment filed Dec. 18, 2007 in U.S. Appl. No. 11/209,092.
Final Office Action mailed Mar. 17, 2008 in U.S. Appl. No. 11/209,092.
Amendment filed May 19, 2008 in U.S. Appl. No. 11/209,092.
Notice of Allowance mailed Jun. 2, 2008 in U.S. Appl. No. 11/209,092.

* cited by examiner

FLUID BLOCKER FOR AN INTAKE MANIFOLD

CROSS-REFERENCE TO RELATED APPLICATIONS

This application is a division of U.S. Pat. No. 7,441,551, currently U.S. application Ser. No. 11/209,092, titled "Intake Manifold", filed on Aug. 22, 2005, and which was allowed on Jun. 2, 2008. The '092 application is hereby incorporated by reference.

BACKGROUND

The present invention relates generally to motor vehicles, and in particular the present invention relates to an intake manifold for motor vehicles.

Modern internal combustion engines manage and recirculate crank case gases in an effort to control environmental pollution. Older internal combustion engines designed before adverse effects to the environment were seriously considered, used a tube to simply dump crank case gases into the atmosphere. This resulted in excessive environmental pollution, and systems designed to manage and control crank case gases were introduced. Current internal combustion engine designs use a PCV (Positive Crank Case Ventilation) system to control and manage the release of crank case gases. The PCV system uses a line disposed between the crank case and an intake manifold.

A PCV valve controls the release of crank case gases and vapors from the crank case into the intake manifold. This is done to preserve the air-fuel ratio and other conditions of the combustion gases in the intake manifold.

While known PCV systems have been effective in reducing environmental pollution, current PCV systems still suffer from a number of drawbacks. One major problem is moisture. Crank case gases and vapors can include moisture. Moisture is generally not a problem when diffused throughout the crank case gases and the intake manifold. However, when condensation occurs or when moisture levels increase, this can adversely affect engine performance. One particular problem is when condensation occurs and the moisture accumulates into droplets. These droplets can be ingested by a combustion chamber of a cylinder and severely impair combustion. Another problem occurs when the droplets freeze due to low temperature. When a frozen droplet is ingested by a cylinder, very serious problems can occur during the combustion process. Related PCV systems have not effectively addressed the problem of moisture and condensation.

SUMMARY OF THE INVENTION

An intake manifold that helps to control moisture and condensation is disclosed. The invention can be used in connection with a motor vehicle. The term "motor vehicle" as used throughout the specification and claims refers to any moving vehicle that is capable of carrying one or more human occupants and is powered by any form of energy. The term motor vehicle includes, but is not limited to cars, trucks, vans, minivans, SUVs, motorcycles, scooters, boats, personal watercraft, and aircraft.

The intake manifold generally provides a tortuous path through two separate manifold chambers that are in fluid communication with each other. As the PCV gases travel through the chambers, the gases cool and fluids evaporate or condense out of the PCV gas. The PCV gas is then fed to one or more cylinder ports through a port hole. A fluid blocker is provided proximate the port hole to inhibit the condensed gases from being ingested by the cylinder port. The condensed fluids are trapped within the intake manifold by a blocking portion of the fluid blocker. The blocking portion extends above a lower surface of one of the manifold chambers so that fluid can accumulate within the manifold chamber but cannot enter the port hole. The fluid blocker may be integrally formed with the manifold chamber or may be modular.

In one aspect, the invention provides an intake manifold comprising a chamber configured to receive PCV gas; the chamber having a bottom; a port hole disposed in the bottom of the chamber, the port hole placing the chamber in fluid communication with a port; a fluid blocker associated with the bottom of the chamber, the fluid blocker extending an altitude above the bottom of the chamber; and where the fluid blocker prevents fluid below the altitude from entering the port hole.

In another aspect, the invention provides an intake manifold comprising a first chamber in fluid communication with a PCV line, a second chamber in fluid communication with the first chamber, wherein the first chamber is upstream of the second chamber, a gasket separating the first chamber and the second chamber, a port hole formed in a bottom of the second chamber so that the second chamber is in fluid communication with a port, and a fluid blocker positioned proximate the port hole, wherein the fluid blocker is configured to trap fluid within the second chamber.

In another aspect, the invention provides fluid blocker comprising a blocking portion configured to be positioned proximate a port hole disposed in an intake manifold, wherein the blocking portion is configured to trap a fluid within the intake manifold.

Other systems, methods, features and advantages of the invention will be, or will become, apparent to one with skill in the art upon examination of the following figures and detailed description. It is intended that all such additional systems, methods, features and advantages be included within this description, be within the scope of the invention, and be protected by the following claims.

BRIEF DESCRIPTION OF THE DRAWINGS

The invention can be better understood with reference to the following drawings and description. The components in the figures are not necessarily to scale, emphasis instead being placed upon illustrating the principles of the invention. Moreover, in the figures, like reference numerals designate corresponding parts throughout the different views.

DETAILED DESCRIPTION

Figure 1:
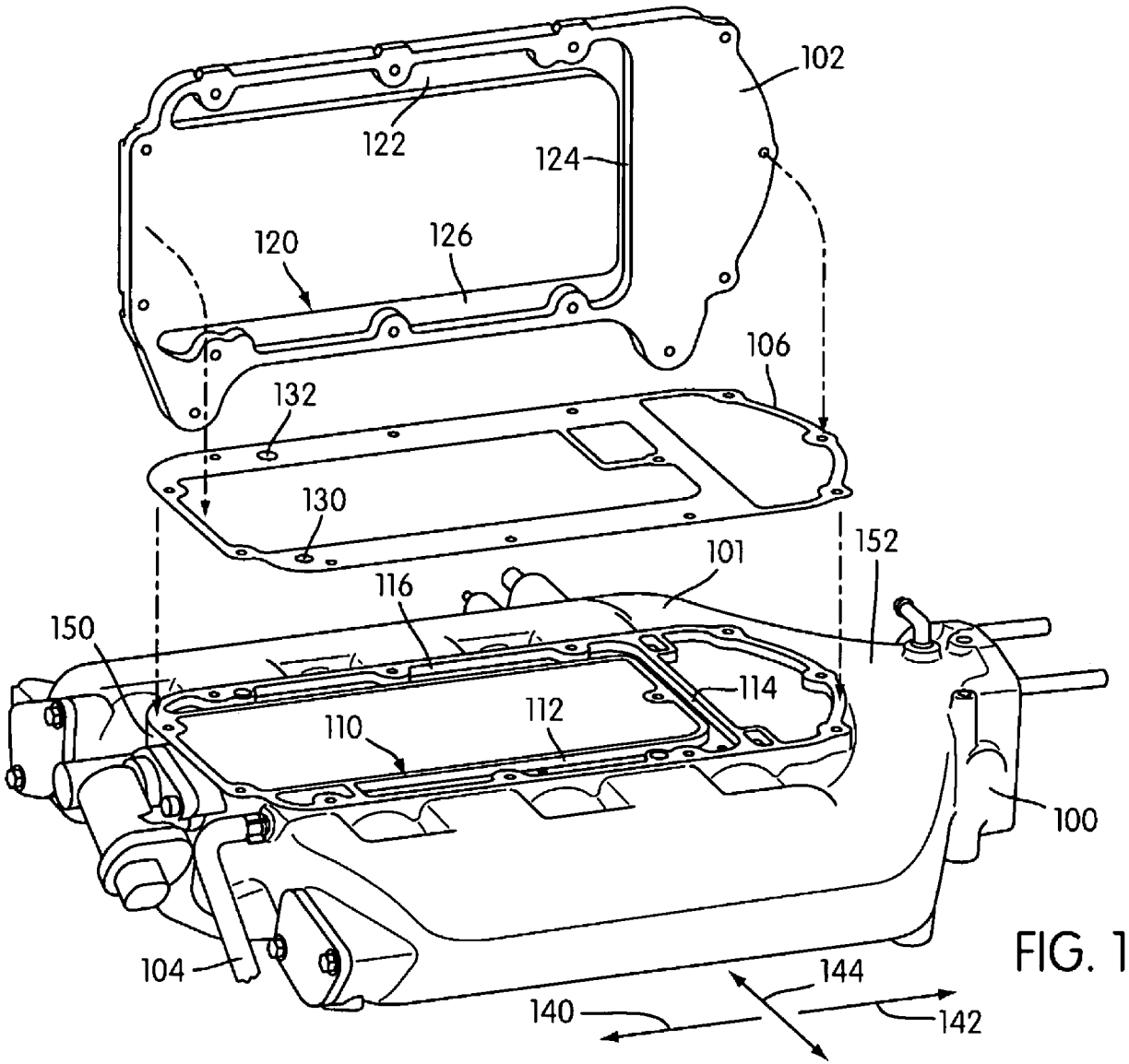
FIG. 1 is an exploded view of a preferred embodiment of an intake manifold and an upper cover.

Embodiments of the present invention help to manage and control moisture entrained with PCV gas. FIG. 1 is an exploded view of a preferred embodiment of a manifold 100 and an upper cover 102. Preferably, upper cover 102 is configured to engage an upper portion 101 of manifold 100. In the embodiment shown in FIG. 1, manifold 100 includes a forward portion 150 that is configured to receive PCV line 104. As known in the art, the opposite end of PCV line 104 is connected to the interior of a crank case (not shown). PCV line 104 places the interior of the crank case in fluid communication with manifold 100 and is capable of delivering crank case gases through PCV line 104 to manifold 100.

Throughout this description, general direction and location terms are used. Some examples of these kinds of terms include forward, rearward, upper and lower. These terms are merely used to assist in describing the relative location of a certain item or portion. These terms are not intended to absolutely define the location or position of a certain item or part in any frame of reference or to the motor vehicle. This is particularly true in the case of a transverse engine. Forward or rearward relative to an engine block that is transversely mounted may actually refer to a lateral direction across the width of the motor vehicle.

Manifold 100 preferably includes provisions to receive PCV gases. In the embodiment shown in FIG. 1, manifold 100 includes a manifold groove 110. Manifold groove 110 comprises a first manifold groove portion 112, a second manifold groove portion 114, and a third manifold groove portion 116. Preferably, first manifold groove 112 is in fluid communication with second manifold groove portion 114, and second manifold groove portion 114 is in fluid communication with third manifold groove portion 116. In the embodiment shown in FIG. 1, first manifold groove portion 112 includes an upstream end in fluid communication with PCV line 104 and downstream end in fluid communication with second manifold groove portion 114. Preferably, first manifold groove portion 112 is disposed longitudinally with respect to manifold 100. Also, as shown in the embodiment of FIG. 1, second manifold groove portion 114 is disposed generally laterally with respect to manifold 100 and third manifold groove portion 116 is disposed in a generally longitudinally direction. In the embodiment shown in FIG. 1, first manifold groove portion 112 is laterally spaced from third manifold groove portion 116. In some embodiments, first manifold groove portion 112 is generally parallel with third manifold groove portion 116.

Preferably, manifold 100 includes an upper cover 102. In some embodiments, a seal or joint packing is provided between manifold 100 and upper cover 102. In the embodiment shown in FIG. 1, a gasket 106 is disposed between manifold 100 and upper cover 102. Gasket 106 can help to provide a seal between manifold 100 and upper cover 102.

Preferably, upper cover 102 includes provisions to receive PCV gas. In the preferred embodiment shown in FIG. 1, upper cover 102 includes an upper cover groove 120. Preferably, upper cover groove 120 comprises a first upper cover groove portion 122, a second upper cover groove portion 124, and a third upper cover groove portion 126. Preferably, first upper cover groove portion 122 includes an upstream end configured to receive PCV gas from PCV line 104 and a downstream end in fluid communication with the upstream end of second upper cover groove portion 124. Preferably, the downstream end of the second upper cover groove portion 124 is in fluid communication with the upstream end of third upper cover groove portion 126.

Figure 2:
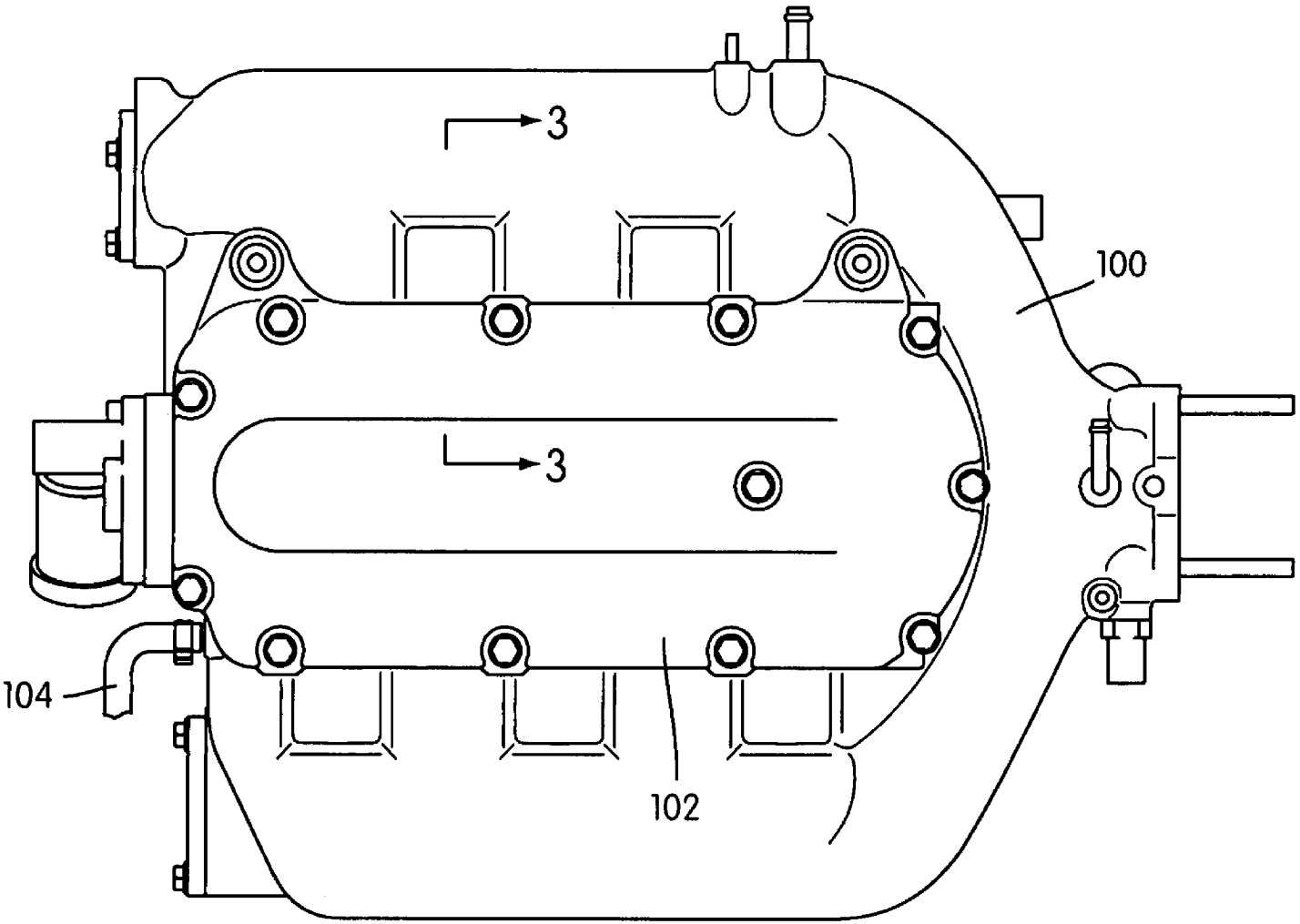
FIG. 2 is a top view of a preferred embodiment of an assembled upper cover and intake manifold.
Figure 3:
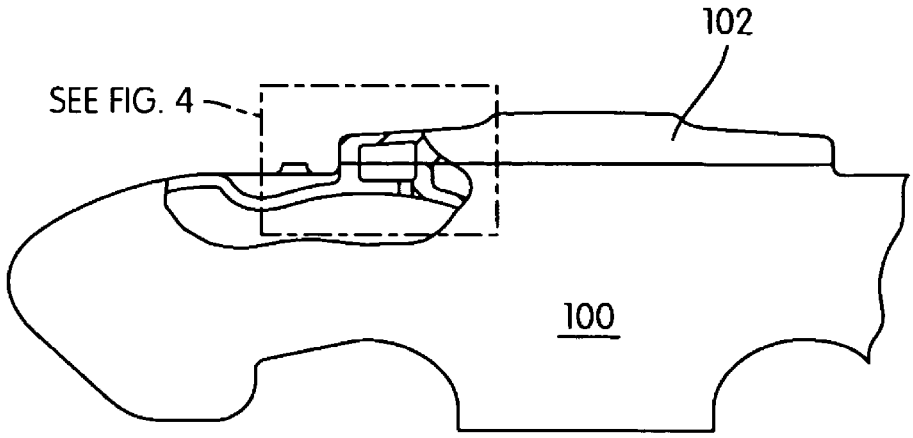
FIG. 3 is a preferred embodiment of section 3-3 in FIG. 2.
Figure 4:
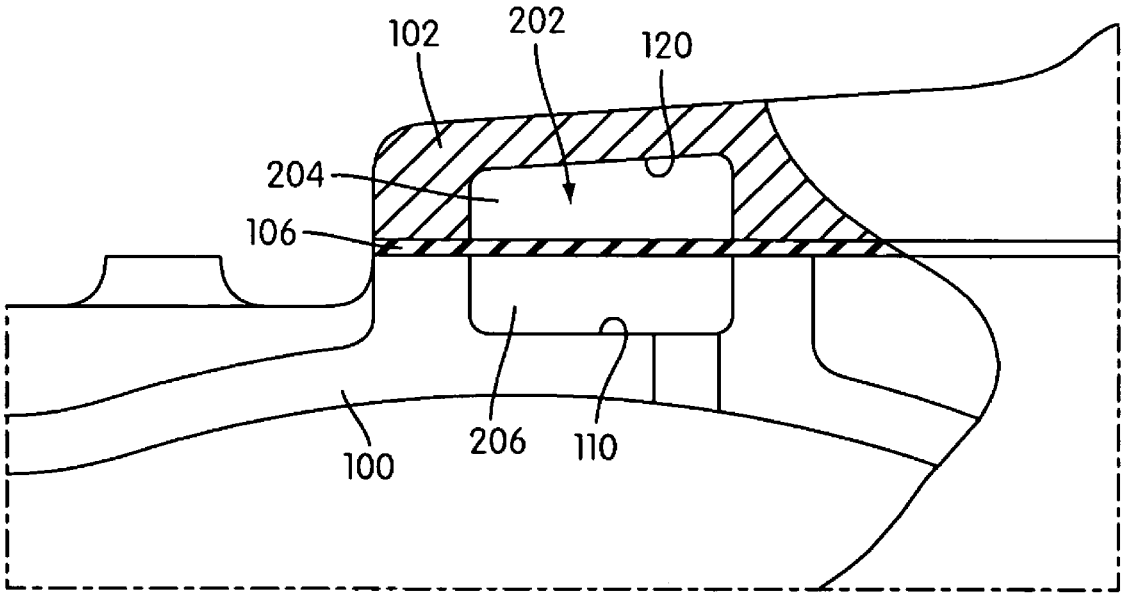
FIG. 4 is an enlarged cross-sectional view of the box shown in FIG. 3.

In a preferred embodiment, upper cover groove 120 generally corresponds with manifold groove 110 after upper cover 102 has been assembled with manifold 100. A top view of the assembled manifold with upper cover 102 is shown in FIG. 2. Section 3-3 provides a cross-sectional view of the assembled upper cover 102 and manifold 100. Referring to FIGS. 3 and 4, details of the assembled system can be observed.

After assembly, upper cover groove 120 and manifold groove 110 form a chamber 202. Gasket 106 is disposed between upper cover 102 and manifold 100 and can act to separate chamber 202 into two chambers: a first chamber 204 and a second chamber 206. In the embodiment shown in FIG. 4, cover groove 120 forms first chamber 204 and manifold groove 110 forms second chamber 206. These two chambers help to create a unique flow path that can assist in managing and controlling moisture, fluid and/or water entrained with PCV gases.

Figure 5:
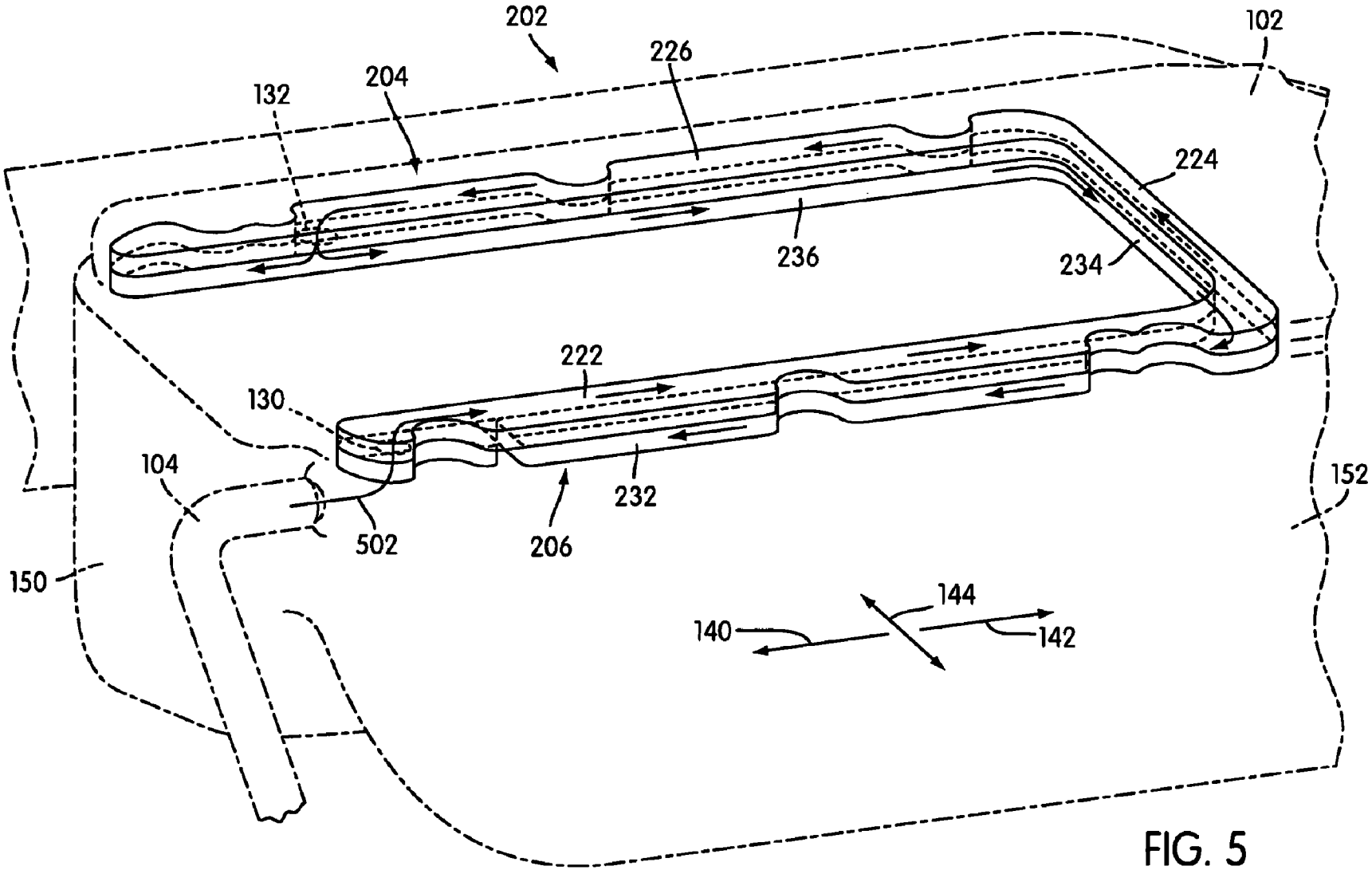
FIG. 5 is a schematic diagram of a preferred embodiment of a chamber.

FIG. 5 is a schematic diagram of a preferred embodiment of chamber 202. A preferred flow path for the PCV gas can be observed in FIG. 5. PCV gas 502 is delivered from PCV line 104 to first chamber 204. In the embodiment shown in FIG. 5, a first section 222 of first chamber 204 receives incoming PCV gas 502. First section 222 of first chamber 204 is preferably formed by first cover groove portion 122 (see FIG. 1). First section 222 of first chamber 204 is disposed in a generally longitudinally direction where the upstream end of first section 222 is disposed forward of the rear downstream end. The downstream end of first section 222 is in fluid communication with the second section 224 of first chamber 204. Preferably, second section 224 is formed by second cover groove portion 124 (see FIG. 1). PCV gas 502 generally travels in a lateral direction 144 through second section 224 of first chamber 204. The downstream end of second section 224 is in fluid communication with the third section 226 of first chamber 204. Preferably, the third section 226 of first chamber 204 is formed by third cover groove portion 126 (see FIG. 1). Third section 226 preferably extends in a generally longitudinally direction and, in the embodiment shown in FIG. 5, third section 226 runs generally parallel with first section 222. The inlet of third section 226 is disposed in a generally rearward longitudinal direction 142 and the downstream end is disposed in a generally forward longitudinal direction 140.

Preferably, a chamber hole 132 is disposed near the downstream portion of third section 226 of first chamber 204. Preferably, chamber hole 132 places first chamber 204 in fluid communication with second chamber 206. In the embodiment shown in FIG. 5, chamber hole 132 places the general downstream portion of third section 226 of first chamber 204 in fluid communication with the upstream portion of third section 236 of second chamber 204. Third section 236 has an upstream portion that is disposed in a generally forward longitudinal direction 140 and a downstream portion that is disposed in a generally rearward longitudinal direction 142. PCV gas 502 travels down the length of third section 236 of second chamber 206 to the second section 234 of second chamber 206.

Second section 234 of second chamber 206 is preferably laterally disposed and connects the downstream end of third section 236 with the upstream end of first section 232 of second chamber 206. Preferably, first manifold groove portion 112 forms first section 232 of second chamber 206 and second manifold groove portion 114 forms the second section 234 of second chamber 206 and third manifold groove portion 116 forms the third section 236 of second chamber 206.

This arrangement provides a flow path where PCV gas 502 is required to travel down the entire length of first chamber 204, travel from first chamber 204 to second chamber 206 through chamber hole 132 and then travel the entire length of second chamber 206. This long and tortuous flow path makes it difficult for water droplets, fluid or moisture to remain concentrated and cohesive throughout the entire flow path. Because of the lengthy flow path, fluid, moisture, and/or water droplets can evaporate or dissipate while traveling through first chamber 204 or second chamber 206. Also, fluid, moisture, and/or water droplets may become trapped in first chamber 204, never reaching second chamber 206.

The preferred arrangement shown in FIG. 5 also helps to prevent ice from being ingested by the internal combustion engine. Icing can occur when condensation or water droplets freeze after the engine has been turned off. Because of the long and tortuous path shown schematically in FIG. 5, it is unlikely that water droplets will reach second chamber 206. If water droplets are present in first chamber 204, and those water droplets become frozen, the frozen water droplets in first chamber 204 do not pose a threat of being ingested by the cylinders of the internal combustion engine because of their location. After the engine has been turned on and running for a period of time, it is possible that the frozen water droplets will thaw and then eventually evaporate.

Figure 6:
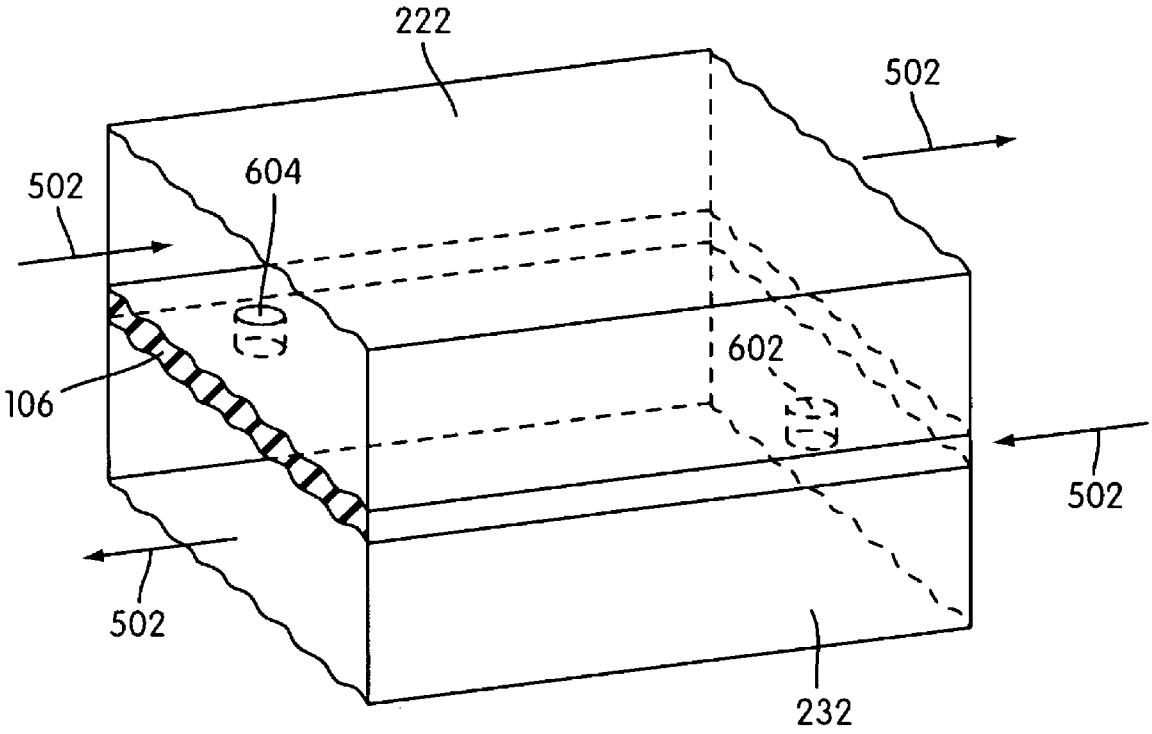
FIG. 6 is an enlarged schematic diagram of a preferred embodiment of a chamber.
Figure 7:
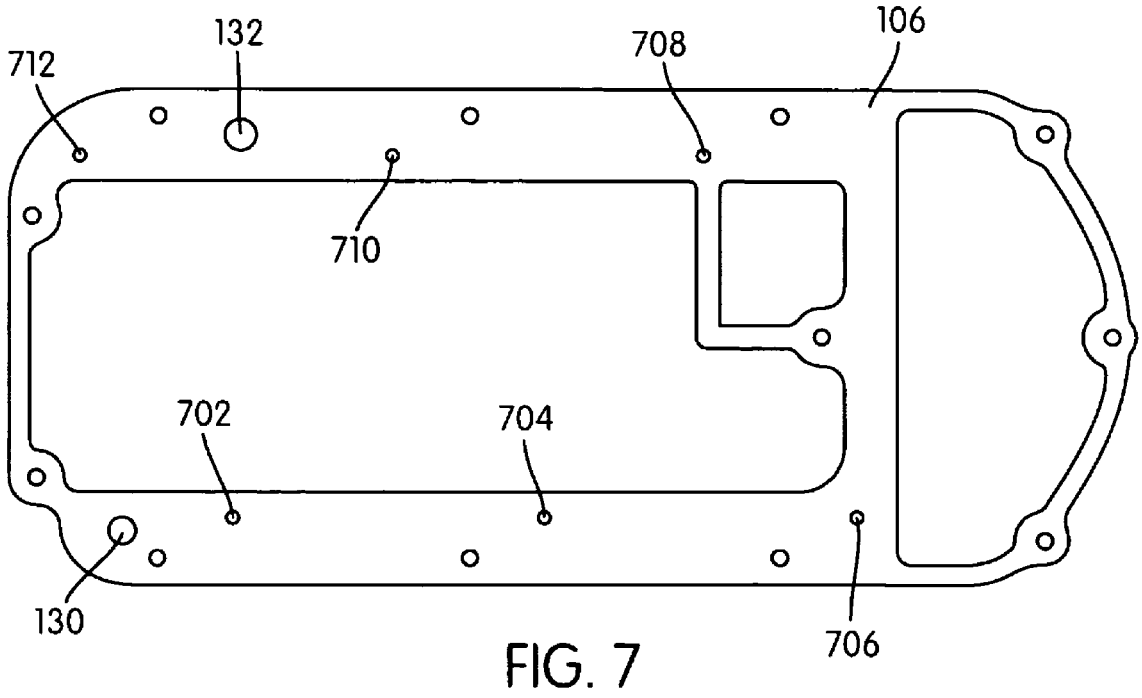
FIG. 7 is a top view of a preferred embodiment of a gasket.

In some embodiments, additional holes besides chamber hole 132 can be provided. FIG. 6 is an enlarged schematic diagram of a portion of first chamber 204 and second chamber 206. FIG. 6 shows a portion of first section 222 of first chamber 204 and first section 232 of second chamber 206. One or more vent holes 602 and 604 can be provided through gasket 106. These vent holes 602 and 604 can be used to provide different flow conditions and to assist in moving PCV gas 502 from first chamber 204 to second chamber 206 without significantly impairing the moisture control benefits of the two chamber design. In an exemplary embodiment, one vent hole is provided for each cylinder port. This arrangement is shown in FIG. 7 where six vent holes 702-712 are provided for each of the corresponding six ports. Gasket 106 may include additional holes to accommodate bolts that used to join upper cover 102 with manifold 100.

Figure 8:
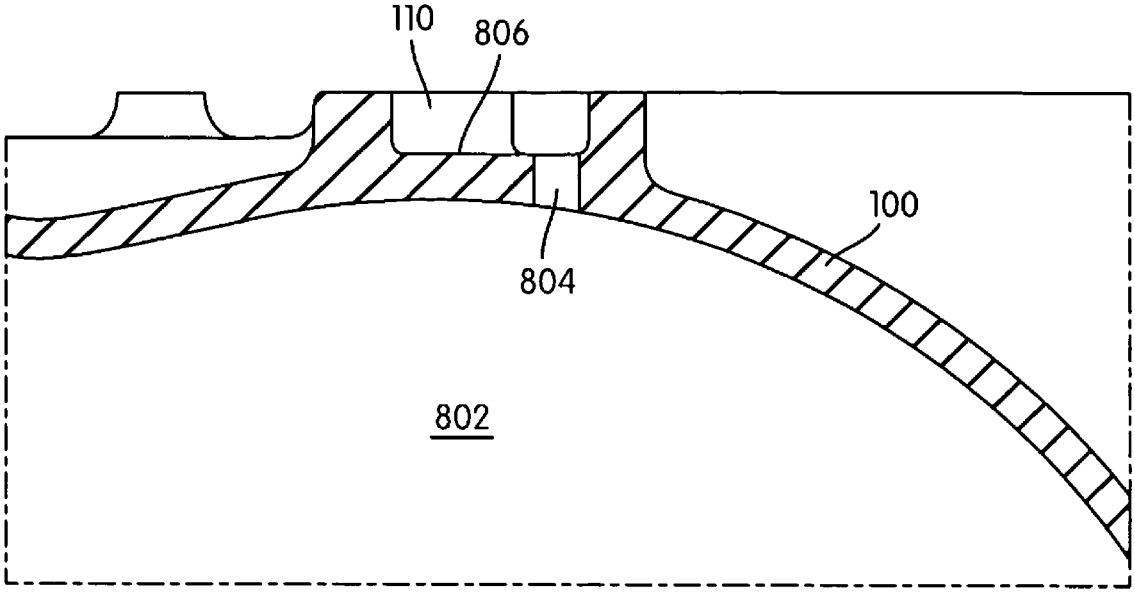
FIG. 8 is an enlarged cross-sectional view of a preferred embodiment of a manifold groove.
Figure 9:
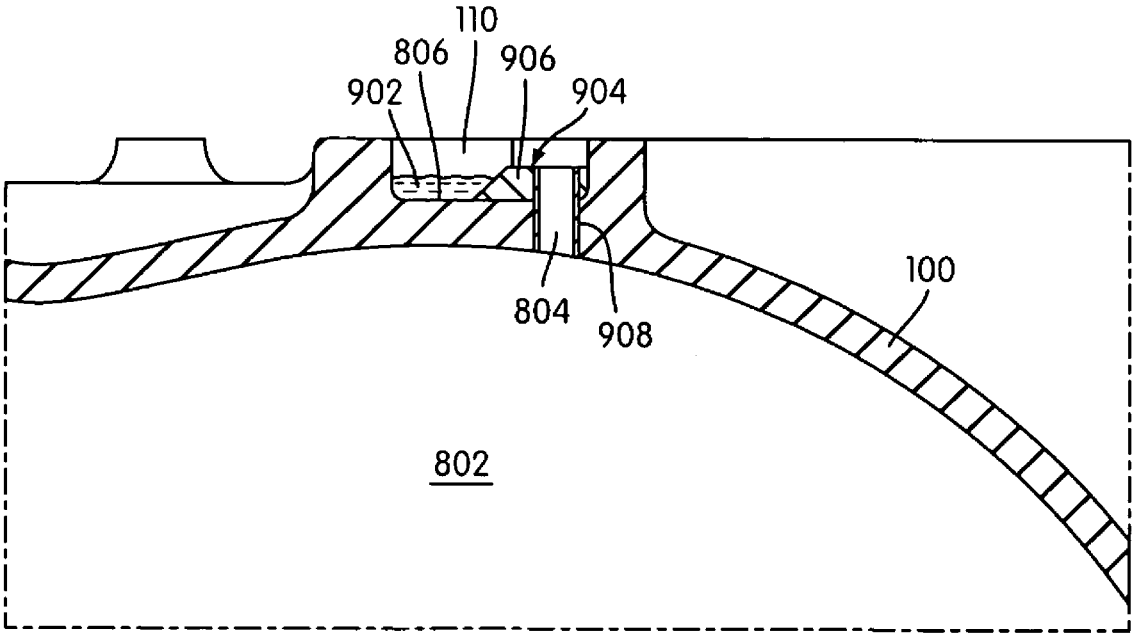
FIG. 9 is an enlarged cross-sectional view of a preferred embodiment of an upper portion of a manifold with a fluid blocker.

Some embodiments include an optional feature that prevent moisture, fluid or water from entering a port hole. FIGS. 8 and 9 are enlarged cross-sectional views of an upper portion 101 of manifold 100. As shown in FIG. 8, manifold groove 110 includes a bottom 806. The bottom 806 of manifold groove 110 can include a port hole 804. Port hole 804 is used to deliver PCV gases from the second chamber 206 to port 802. As well known in the art, port 802 provides a gas with the appropriate amount of intake air or fresh air for a corresponding cylinder of an internal combustion engine. PCV gases mix with the intake air or fresh air in portion 802 and the PCV gases are eventually burned along with the air fuel mixture in the cylinder.

In some cases, fluid, moisture and/or water can reach the bottom 806 of manifold groove 110. If fluid reaches the bottom 806 of manifold groove 110, the fluid can enter port 802. To prevent this, some embodiments include an optional fluid blocker 904 as shown in FIG. 9. In some embodiments, fluid blocker 904 includes a blocking portion 906. Blocking portion 906 can be raised a predetermined altitude above bottom 806 of manifold groove 110. As shown in FIG. 9, this can help to provide a fluid trap so that fluid 902 is prevented from entering port hole 804.

In some embodiments, fluid blocker 904 is integrally formed with manifold 100, in other embodiments, fluid blocker 904 is separate from manifold 100. In one embodiment, shown in FIG. 9, fluid blocker 904 includes an insert portion 908 that is shaped to correspond with port hole 804 and fit into port 804, and a blocking portion 906 connected to insert portion 908. A fluid blocker having this modular design can be retrofitted into existing manifolds.

Figure 10:
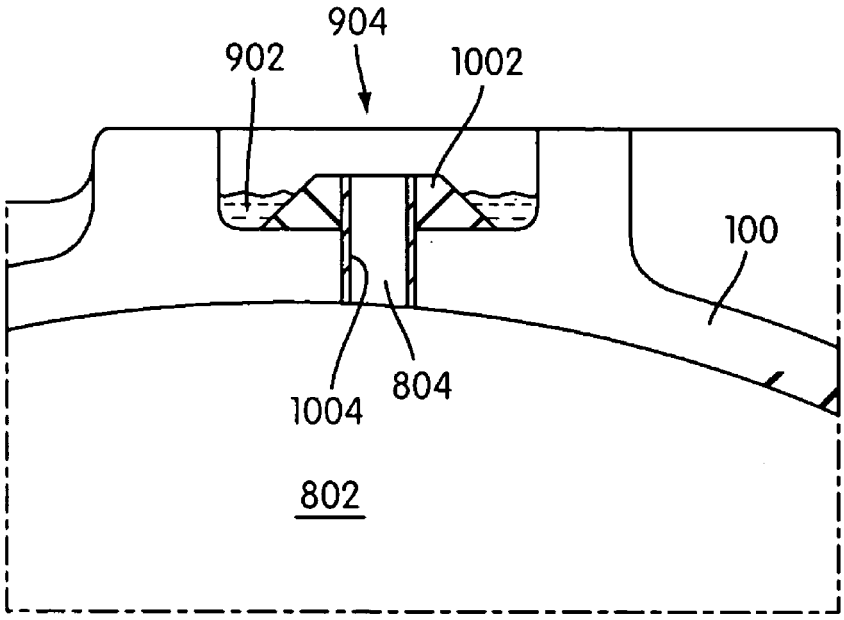
FIG. 10 is an enlarged cross-sectional view of a preferred embodiment of an upper portion of a manifold with a fluid blocker.
Figure 11:
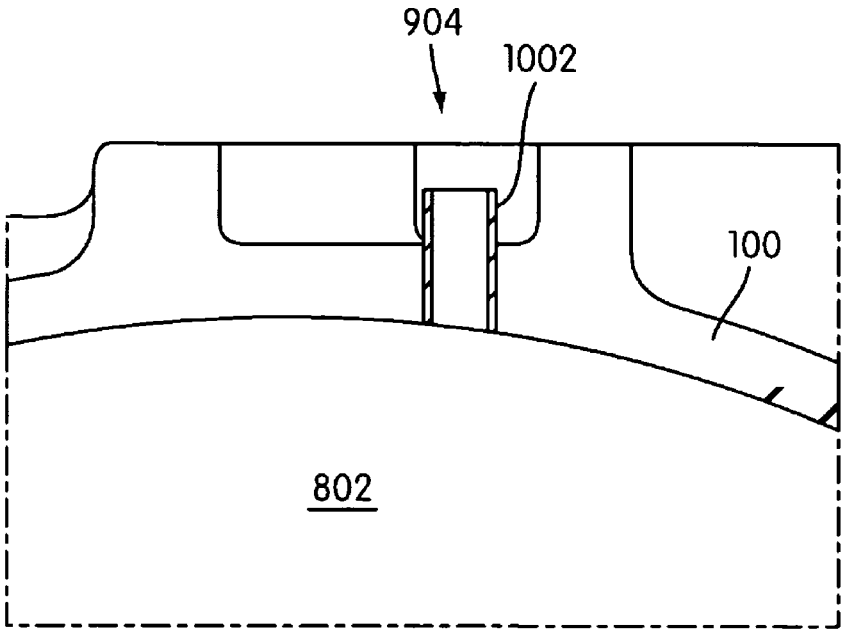
FIG. 11 is a cross-sectional view of a preferred embodiment of an upper portion of a manifold with a fluid blocker.
Figure 14:
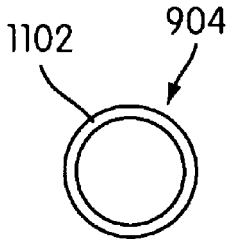
FIG. 14 is a top view of a preferred embodiment of a fluid blocker.
Figure 15:
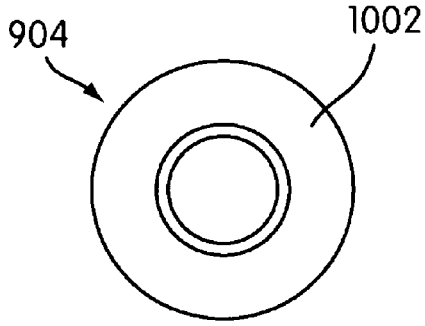
FIG. 15 is a top view of an alternate embodiment of a preferred embodiment of a fluid blocker.

Of course, fluid blocker 904 is not limited to the specific embodiment shown in FIG. 9. Alternate designs are also possible. FIG. 10 shows an alternate embodiment of fluid blocker 904. In this embodiment, fluid blocker 1002 has a tapered, conical shape with a flat, upper surface. Blocking portion 1002 can be integrally formed or be made as an insert with an insert portion 1004 as shown in FIG. 10. FIG. 15 shows a top view of blocking portion 1002. FIG. 11 shows another alternative embodiment of fluid blocker 904. In this embodiment, fluid blocker 904 is a cylindrical member where the insert portion and the blocking portion are similar. A top view of this embodiment is shown in FIG. 14.

Figure 12:
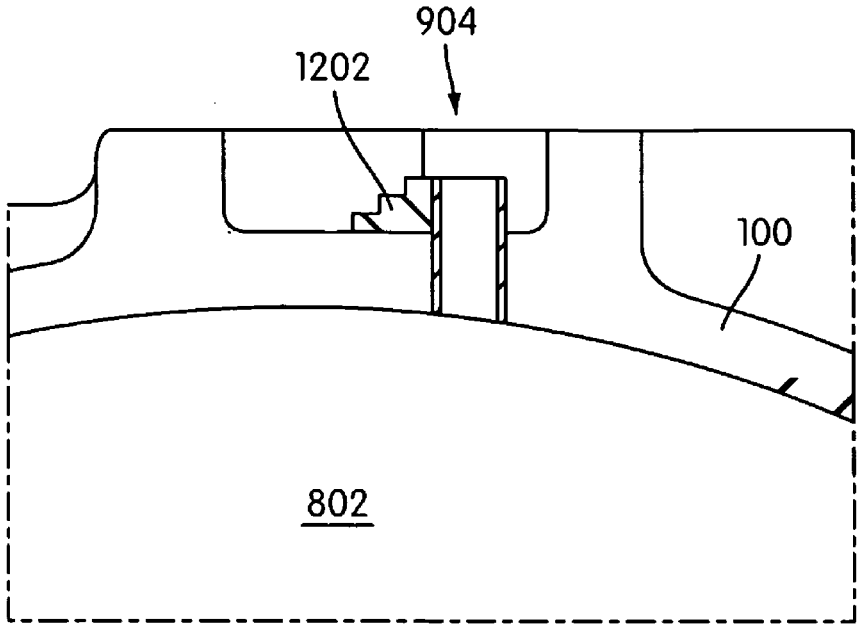
FIG. 12 is an enlarged cross-sectional view of a preferred embodiment of an upper portion of a manifold with a fluid blocker.
Figure 13:
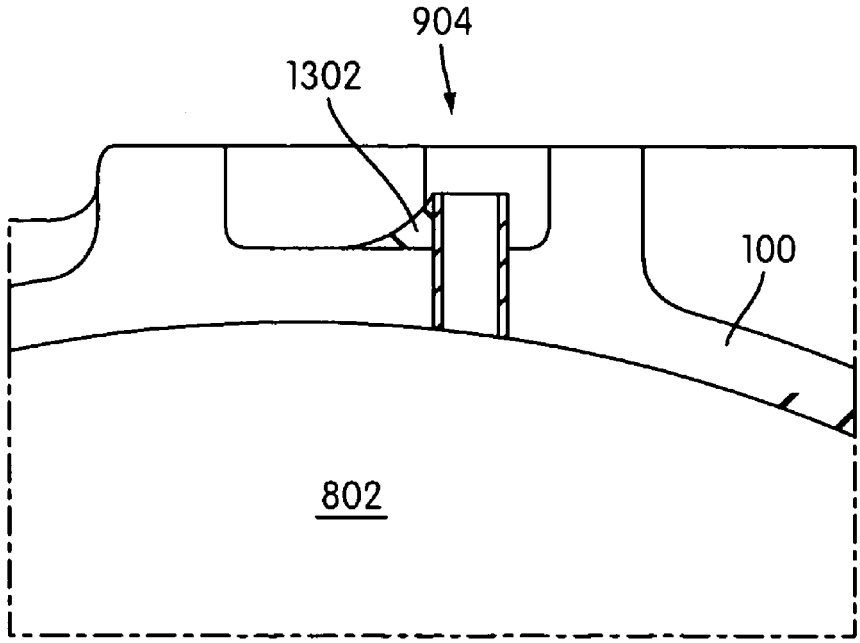
FIG. 13 is an enlarged cross-sectional view of a preferred embodiment of an upper portion of a manifold with a fluid blocker.
Figure 16:
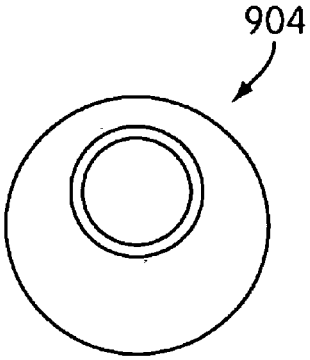
FIG. 16 is a top view of an alternate embodiment of a preferred embodiment of a fluid blocker.
Figure 17:
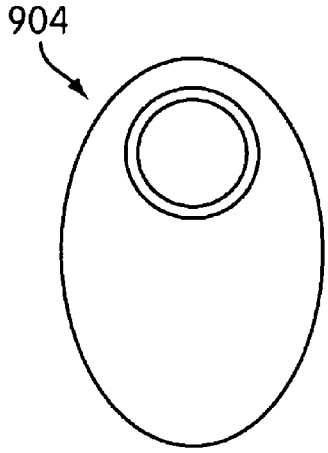
FIG. 17 is a top view of a preferred embodiment of an alternate fluid blocker.
Figure 18:
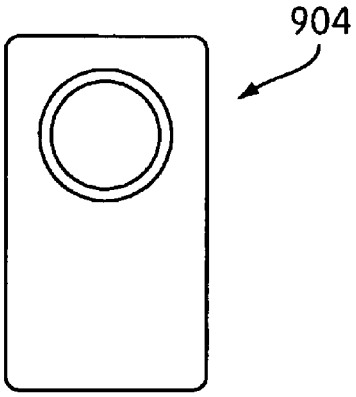
FIG. 18 is a top view of a preferred embodiment of an alternate fluid blocker.
Figure 19:
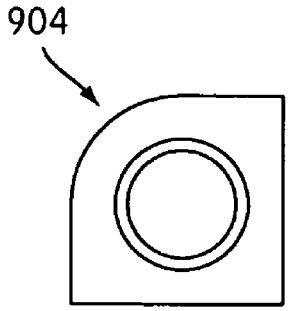
FIG. 19 is a top view of a preferred embodiment of an alternate fluid blocker.

While some embodiments include tapered sides, it is possible to provide side shapes of different designs. FIG. 12 shows a fluid blocker 904 with a stepped side 1202 and FIG. 13 shows an embodiment of a fluid blocker 904 with a sloped side 1302 that is non-linear. Any other suitable shape can be used for the side of fluid blocker 904. In addition to different shapes for the sides of fluid blocker 904, the overall shape or footprint of fluid blocker 904 can be different. In addition to the embodiments shown in FIGS. 14 and 15, FIGS. 16 and 17 show different embodiments of top view of fluid blocker 904. As shown in FIGS. 16 and 17, the blocking portions can be circular or oval and can be offset, and as shown in FIGS. 18 and 19, the blocking portions can include square or rectangular sides. The various shapes can be selected to fit into certain manifolds and to provide different flow blocking or fluid trapping characteristics.

In some embodiments, fluid blockers are provided on one or more ports, and in a preferred embodiment, all of the ports of a manifold include a fluid blocker.

In some embodiments, the optional fluid blockers can be used in combination with the two chamber flow path disclosed above. One or more of these features can be used to help manage and control the introduction of fluid, moisture and/or water into port 802, and ultimately prevent the cylinders of the internal combustion engine from ingesting fluid, moisture, water and/or ice.

While various embodiments of the invention have been described, the description is intended to be exemplary, rather than limiting and it will be apparent to those of ordinary skill in the art that many more embodiments and implementations are possible that are within the scope of the invention. Accordingly, the invention is not to be restricted except in light of the attached claims and their equivalents. Also, various modifications and changes may be made within the scope of the attached claims.

What is claimed is:

1. An intake manifold comprising:

a chamber configured to receive PCV gas, wherein the chamber is formed by a groove disposed in the intake manifold;

the chamber having a bottom;

a port hole disposed in the bottom of the chamber, the port hole placing the chamber in fluid communication with a port;

a fluid blocker associated with the bottom of the chamber, the fluid blocker extending an altitude above the bottom of the chamber;

wherein the fluid blocker prevents fluid below the altitude from entering the port hole; and wherein the fluid blocker is configured to allow the PCV gas above the altitude to enter the port hole.

2. The intake manifold according to claim 1, wherein the fluid blocker is configured to prevent ice from entering the port hole.

3. The intake manifold according to claim 1, wherein the fluid blocker includes a blocking portion and an insert portion, the insert portion shaped to correspond with the port hole.

4. The intake manifold according to claim 1, wherein the fluid blocker includes a blocking portion having a sloped side.

5. The intake manifold according to claim 1, wherein the fluid blocker includes a blocking portion having a stepped side.

6. The intake manifold according to claim 1, wherein the fluid blocker includes a blocking portion having a curved side.

7. The intake manifold according to claim 1, wherein the fluid blocker includes an asymmetrical footprint.

8. The intake manifold according to claim 1, wherein the fluid blocker includes a generally symmetrical footprint.

9. An intake manifold comprising:

a chamber defined by a groove formed in an upper portion of the intake manifold, the chamber configured to receive PCV gas;

the chamber having a bottom;

a port hole disposed in the bottom of the chamber, the port hole placing the chamber in fluid communication with a port;

a fluid blocker positioned proximate the port hole; and wherein the fluid blocker is configured to trap fluid within the chamber by preventing the fluid from entering the port hole while allowing PCV gas to flow out of the chamber through the port hole.

10. The intake manifold according to claim 9, wherein the fluid blocker is integrally formed with the bottom of the chamber.

11. The intake manifold according to claim 9, wherein the chamber is positioned downstream of a second chamber, wherein the second chamber is in fluid communication with the chamber, and wherein the second chamber is separated from the chamber by a gasket.

12. The intake manifold according to claim 9, wherein the fluid blocker comprises a modular element configured to be associated with the port hole.

13. The intake manifold according to claim 9, wherein the fluid blocker comprises an insert portion and a blocking portion, wherein the insert portion is configured to be inserted into the port hole and the blocking portion is configured to extend to a predetermined altitude above the bottom of the chamber.

14. The intake manifold according to claim 13, wherein the fluid blocker includes a sloped side.

15. The intake manifold according to claim 9, wherein the fluid blocker comprises a blocking portion and an insert portion, wherein the insert portion is configured to be inserted into the port hole, and wherein the blocking portion is configured to be positioned proximate the port hole.

16. An intake manifold comprising:

a chamber configured to receive PCV gas, wherein the chamber is a flow path formed in the intake manifold;

the chamber having a bottom;

a port hole disposed in the bottom of the chamber, the port hole placing the PCV gas in the chamber in fluid communication with a port;

a fluid blocker;

the fluid blocker comprising a blocking portion configured to be positioned proximate the port hole; and wherein the blocking portion is configured to trap a fluid within the chamber.

17. The intake manifold according to claim 16, wherein the fluid blocker further comprises an insert portion associated with the blocking portion, the insert portion configured to be inserted into the port hole.

18. The intake manifold according to claim 17, wherein the blocking portion and the insert portion are modular and retrofitted into the port hole.

19. The intake manifold according to claim 16, wherein the port hole is formed in a bottom of a manifold groove, and wherein the blocking portion extends a predetermined altitude above the bottom of the manifold groove to trap the fluid within the manifold groove.

20. The intake manifold according to claim 16, wherein the intake manifold provides a tortuous pathway for delivering a gas to the port hole, and wherein the fluid is comprised of condensation from the gas.

* * * * *

UNITED STATES PATENT AND TRADEMARK OFFICE

CERTIFICATE OF CORRECTION

PATENT NO. : 7,845,341 B2
APPLICATION NO. : 12/197828
DATED : December 7, 2010
INVENTOR(S) : Joel K. Lewis et al.

It is certified that error appears in the above-identified patent and that said Letters Patent is hereby corrected as shown below:

On the title page, section (75),

"Inventors," fourth line, change "Tanabe Yuichiro, Dublin, OH (US)" to --Yuichiro Tanabe, Dublin, OH (US)--

Signed and Sealed this
First Day of February, 2011

David J. Kappos

David J. Kappos
*Director of the United States Patent and Trademark Office*